US006273061B1

(12) United States Patent
Hosoi

(10) Patent No.: US 6,273,061 B1
(45) Date of Patent: Aug. 14, 2001

(54) THROTTLE CONTROL APPARATUS

(75) Inventor: Keiji Hosoi, Shizuoka-ken (JP)

(73) Assignee: Suzuki Motor Corporation, Hamatsu (JP)

( * ) Notice: Subject to any disclaimer, the term of this patent is extended or adjusted under 35 U.S.C. 154(b) by 0 days.

(21) Appl. No.: 09/452,974

(22) Filed: Dec. 2, 1999

(30) Foreign Application Priority Data

Dec. 9, 1998 (JP) ..... 10-368552
Dec. 18, 1998 (JP) ..... 10-376020

(51) Int. Cl.[7] ..... F02D 9/02
(52) U.S. Cl. ..... 123/333; 123/396; 123/399
(58) Field of Search ..... 123/333, 396, 123/399

(56) References Cited

U.S. PATENT DOCUMENTS 4,305,359 * 12/1981 Mann et al. ..... 123/399
5,048,482 * 9/1991 Kratt et al. ..... 123/333
5,117,791 * 6/1992 Chan et al. ..... 123/333
5,150,679 * 9/1992 Peter ..... 123/333
5,163,402 * 11/1992 Taguchi et al. ..... 123/399
5,823,164 * 10/1998 Seki et al. ..... 123/396
6,047,679 * 4/2000 Matsumoto et al. ..... 123/396
6,073,610 * 6/2000 Matsumoto et al. ..... 123/399
6,109,239 * 8/2000 Watanabe ..... 123/396

FOREIGN PATENT DOCUMENTS 5-99058 4/1993 (JP) .
9-209809 8/1997 (JP) .

* cited by examiner

*Primary Examiner*—Erick Solis
(74) *Attorney, Agent, or Firm*—Flynn, Thiel, Boutell & Tanis, P.C.

(57) ABSTRACT

A throttle control apparatus for an engine is provided with a twofold or redundant detecting unit and when one of the detecting units fails, the maximum opening degree of a throttle valve is decreased, and a control unit controls the engine. The control unit also provides for executing the start of a fuel cut to reduce the maximum engine rotational number to a lower maximum engine rotational number when one detecting unit of the twofold detecting unit fails.

16 Claims, 6 Drawing Sheets

THROTTLE CONTROL APPARATUS

FIELD OF THE INVENTION

The present invention relates to a throttle control apparatus for a vehicle engine, and particularly to a control apparatus provided with a redundant sensor structure for controlling the throttle.

BACKGROUND OF THE INVENTION

There is known an engine of a vehicle provided with a throttle control apparatus having an electrically operated throttle valve. For example, a throttle control apparatus 202 is shown in FIG. 7 wherein an electrically operated throttle valve 204 is installed in an intake path 206 and the throttle valve 204 is operated by a motor 208 for throttle movement. The throttle driving motor 208 communicates with a throttle control unit 210-1 of a control means 210.

To carry out a failsafe operation, a sensor system with a twofold or redundant detecting structure is provided. The throttle control apparatus 202 includes first and second throttle position sensors 212-1 and 212-2, and first and second accelerator position sensors 216-1 and 216-2 communicating with an accelerator pedal 214. The motor 208 for throttle movement includes first and second motor drive coils 218-1 and 218-2.

The first throttle position sensor 212-1 communicates with the throttle control unit 210-1 through a power source supply line 220-1, a ground line 222-1 and an electrical signal output line 224-1. The second throttle position sensor 212-2 communicates with the throttle control unit 210-1 by an electrical signal output line 224-2.

The first accelerator position sensor 216-1 communicates with an engine control unit 210-2 by a power source supply line 226-1, a ground line 228-1 and an electrical signal output line 230-1. The second accelerator position sensor 216-2 communicates with the engine control unit 210-2 by a power source supply line 226-2, a ground line 228-2 and an electrical signal output line 230-2.

The first motor drive coil 218-1 communicates with the throttle control unit 210-1 by a power source supply line 232-1 and a ground line 234-1. The second motor drive coil 218-2 communicates with the throttle control unit 210-1 by a power source supply line 232-2 and a ground line 234-2.

Thereby, when a sensor communication route of any one of the first and second throttle position sensors 212-1 and 212-2, the first and second accelerator position sensors 216-1 and 216-2 or the drive coils 218-1 and 218-2 fails, the driver is informed of the failure by lighting a failure display lamp 236. There is also installed a throttle wire 238 for escape vehicle running during a failure by which the throttle valve 204 is operated such that the vehicle can be driven to a service station. In this case, when one sensor communication route fails, then, for example, there are cases in which supply of power source to the motor 208 for throttle driving is stopped and the vehicle is run at a default opening degree mechanically provided to the throttle valve 204. That is, the throttle is fixed with a throttle opening degree $\theta=15°$, or the throttle valve 204 is mechanically operated via the throttle wire 238 for escape running.

Further, such a failsafe sensor structure is disclosed in, for example, Japanese Patent Laid-Open No. 99058/1993 or Japanese Patent Laid-Open No. 209809/1997. According to the structure described in Japanese Patent Laid-Open No. 99058/1993, there are provided two detecting means for detecting the operating state of a vehicle and operating control of the vehicle is carried out in accordance with an output state of the detecting means. When both of the detecting means are determined to be normal, an object of the control is further safely controlled. According to the structure described in Japanese Patent Laid-Open No. 209809/1997, there are installed multifold detecting means, and in determining detection signals, a determination is carried out in accordance with whether the changing speed of respective detection values fall in reference ranges to thereby promote certainty and conformity of failsafe.

In the throttle control apparatus having two control circuit routes, when one of the control circuits fails, throttle control is carried out by using the other control circuit. However, when one of the two control circuit routes fails (or may be described otherwise as "determined to fail"), there is a high possibility of its being accompanied with other failure in respect to an engine controller or a throttle controller of the control means and when normal throttle opening degree control is carried out, this a concern of causing unnecessary throttle operation in running the vehicle and an improvement has been desired.

However, according to a conventional throttle control apparatus, in the case of a failure of a onefold (i.e., non-redundant) sensor, the throttle control apparatus carries out a corresponding failsafe control when the sensor system fails. Main functions of the failsafe control are notifying an abnormality to the driver by turning on a malfunction indicating lamp (MIL) when the sensor system fails and carrying out a simplified control for escape running such that a vehicle can be driven to a service station which can repair the vehicle.

The function of carrying out the simplified control for escape running can be explained as a function that places a power source of the throttle driving motor in an OFF state when the sensor system fails and allows the vehicle to run with the throttle valve being at a default opening degree mechanically provided to it (for example, opening degree is fixed to 15 degree). Thus, it is intended to run the vehicle by setting the throttle valve to the default opening degree, the vehicle is run regardless of the intention of the driver and, accordingly, there is an inconvenience in which needed depression force exerted on a brake pedal is increased, and a strange feeling is caused in running the vehicle.

Further, in an apparatus which does not carry out the simplified control for escape running, there is an apparatus provided with an auxiliary wire for escape running. According to this construction, the throttle opening degree of the throttle valve is mechanically opened and closed by the wire to thereby enable running when the sensor system is failed. Moreover, when the vehicle is run by mechanically operating the throttle valve with the throttle wire for escape running, there are inconveniences in that the throttle wire and peripheral parts are needed, the number of parts is increased, the construction is complicated and the apparatus becomes increasingly expensive.

SUMMARY OF THE INVENTION

Hence, according to an aspect of the invention, in order to remove the above-described inconveniences and drawbacks of conventional throttle controllers, there is provided a throttle control apparatus for an engine which executes a fuel cut operation at a predetermined engine rotational number to prevent overrevolution the high rotational number region, a throttle valve which is electrically operated to control an operating state of the engine, and a twofold (redundant) detecting means, wherein the control means executes the start of the fuel cut of the engine at a lower rotational number than the predetermined rotational number when one of the twofold detecting means is in a failed state.

According to the invention, when one of the twofold detecting means fails, in consideration of the possibility that the other detecting means may be failed in accordance therewith, it becomes possible that by controlling the engine in a specific operational state, there is no need of increasing the depression force of a brake pedal, strange feeling during running a vehicle can be avoided with parts such as a throttle wire and so on are not needed, the number of parts is reduced, the construction is simplified and the apparatus can be made inexpensively.

According to another aspect of the invention, there is provided a throttle control apparatus having an accelerator position sensor for detecting a depression amount of an accelerator pedal, a throttle position sensor for detecting a throttle opening degree of a throttle valve, a coil of a throttle driving motor for driving the throttle valve and a controller for controlling the throttle opening degree of the throttle valve by communicating with the respective sensors and the coil. The throttle control apparatus further includes two control circuit routes arranged with respective accelerator position sensors, throttle position sensors and coils, and an idle switch for detecting when the accelerator pedal is in an idling operational state, wherein the controller restricts engine output when one of the control circuits is in a failed state and further restricts engine output when the idle switch is in an ON state and the accelerator pedal is brought into the idling operating state.

Therefore, when one of the control circuits fails, the output restriction is carried out by the controller to thereby maintain the running performance in an adequate state and when the idle switch is made ON and the accelerator pedal is brought into the idling operating state, further output restriction is carried out to thereby ensure smooth running of the vehicle engine.

DETAILED DESCRIPTION

Figure 5:
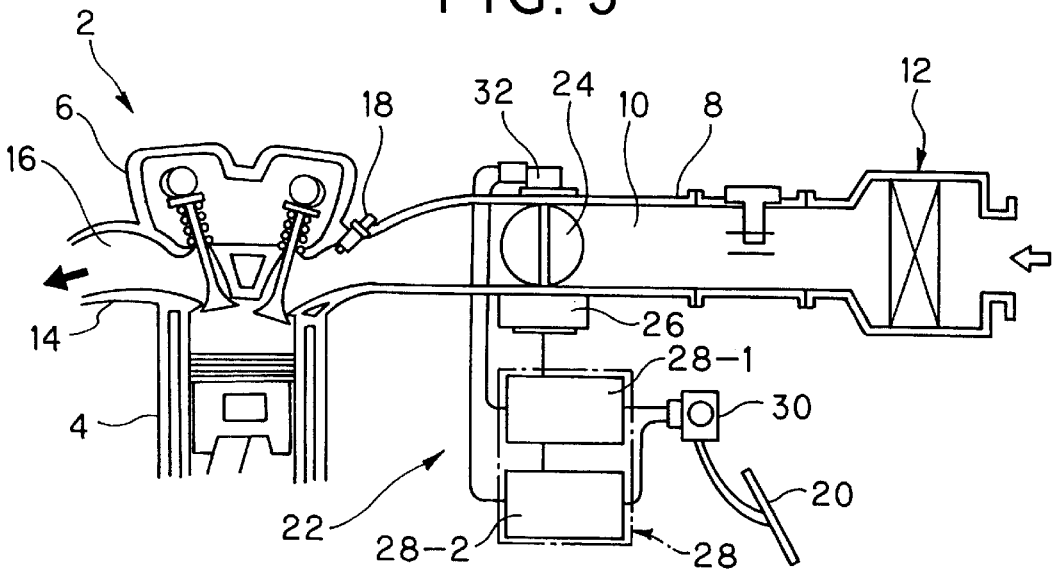
FIG. 5 is a schematic view of a throttle control apparatus environment.

In FIG. 5, 2 designates an engine mounted to a vehicle (not illustrated), 4 designates a cylinder block, 6 designates a cylinder head, 8 designates an intake pipe, 10 designates an intake passage, 12 designates an air cleaner, 14 designates an exhaust pipe, 16 designates an exhaust passage, 18 designates a fuel injection valve, 20 designates an accelerator pedal and 22 designates a throttle control apparatus. The downstream side of intake passage 10, and the upstream side of exhaust passage 16 fluidly communicate with the combustion chamber in the cylinder block 4.

The throttle control apparatus 22 includes an electrically operated throttle valve 24 installed in the intake path 10. The throttle valve 24 is operated by a throttle driving motor 26. The throttle driving motor 26 is driven by a throttle control unit 28-1 of control system 28, which is a computer module or other programmable controller. The throttle control unit 28-1 communicates with an accelerator position sensor 30 which detects the operational and position of the accelerator pedal 20. A throttle position sensor 32 acts as a detecting means for detecting an opening degree of the throttle valve 24 and communicates with an engine control unit 28-2 of the control system 28. The accelerator position sensor 30 and the throttle position sensor 32 further communicate with the engine control unit 28-2.

Figure 6:
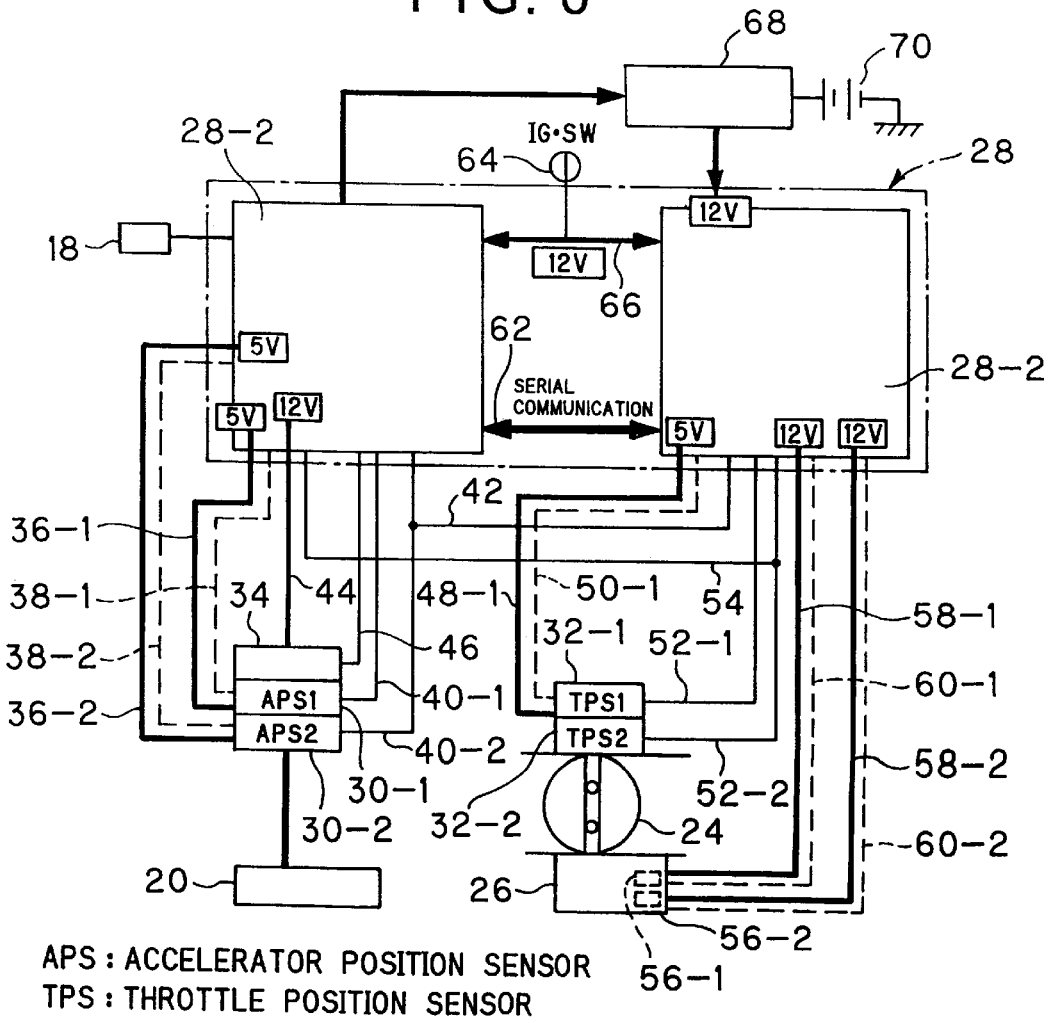
FIG. 6 is a diagram showing wire connections of sensors of the throttle control apparatus.
Figure 7:
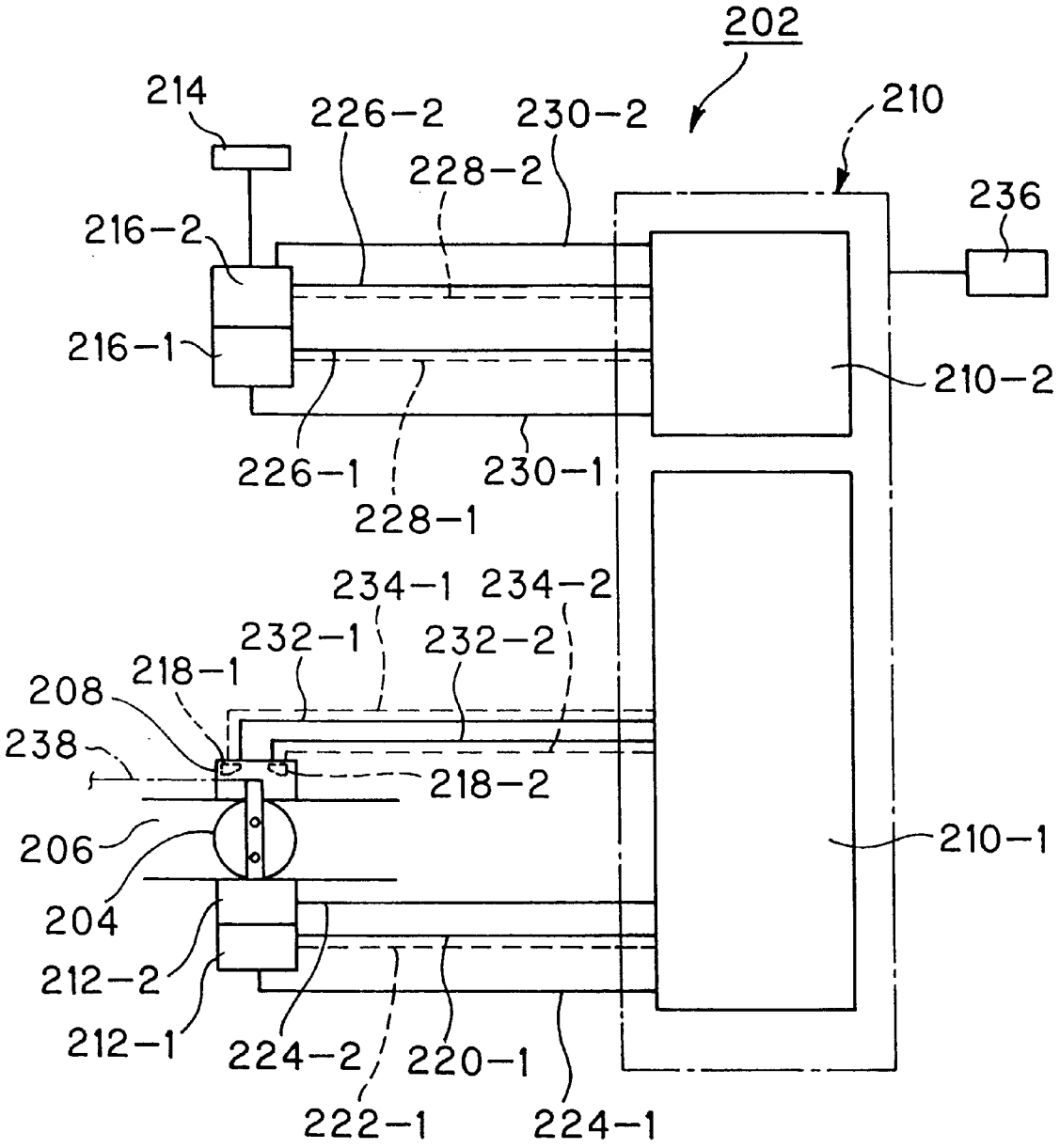
FIG. 7 PRIOR ART
FIG. 7 is a diagram showing wire connections of sensors of a conventional throttle control apparatus.

The throttle control apparatus 22 is provided with a failsafe system installed with a twofold (i.e. redundant) detecting means as shown in FIG. 6. That is, the accelerator pedal 20 communicates with first and second accelerator position sensors (APS) 30-1 and 30-2 and an idle switch 34.

The first accelerator position sensor 30-1 communicates with the engine control unit 28-2 through a power source line 36-1, a ground line 38-1 and an electrical output signal line 40-1. The second accelerator position sensor 30-2 communicates with the engine control unit 28-2 through a power source line 36-2, a ground line 38-2 and an electrical output signal line 40-2. The output line 40-2 for the second accelerator position sensor communicates with the throttle control unit 28-1 via a first electrical communication line 42.

The idle switch 34 communicates with the engine control unit 28-2 through a power source line 44 and an electrical output signal line 46. The idle switch 34 detects an idling operational state of the accelerator pedal 20, and to be more accurate, the idling operating state in which the accelerator pedal 20 is opened. The control unit 28 performs an engine output restriction when one of the control circuits is in a failed state and performs further output restriction when the idle switch 34 is in an ON state and there is brought about the idling operational state in which the accelerator pedal 20 is opened.

Further, the throttle position sensor 32 is redundant and includes first and second throttle position sensors (TPS) 32-1 and 32-2. The first throttle position sensor 32-1 communicates with the throttle control unit 28-1 through a power source line 48-1, a ground line 50-1 and an electrical output signal line 52-1. The second throttle position sensor 32-2 communicates with the throttle control unit 28-1 through an electrical output signal line 52-2. The second throttle position sensor 32-2 can be connected to the power source line 48-1 and ground line 50-1. Further the input line 52-2 for the second throttle position sensor communicates with the engine control unit 28-2 via a second communication line 54.

Further, the throttle driving motor 26 is installed as a twofold (redundant) assembly with first and second motor drive coils 56-1 and 56-2. The first motor drive coil 56-1 communicates with the throttle control unit 28-1 through a power source line 58-1 on the side of the first motor drive coil and a ground line 60-1 on the side of the first motor drive coil. The second motor drive coil 56-2 communicates with the throttle control unit 28-1 through a power source line 58-2 on the side of the second motor drive coil and a ground line 60-2 on the side of the second motor drive coil.

The throttle control unit 28-1 and the engine control unit 28-2 communicate with each other through a serial communication line 62 and an ignition switch electric line 66 which communicate with an ignition switch 64. Further, the engine control unit 28-2 and the throttle control unit 28-1 communicate with each other via a motor relay 68. The motor relay 68 communicates with a battery 70.

In addition, the engine control unit 28-2 communicates with the fuel injection valve(s) 18, through an electrical connection to control the fuel injected therefrom.

When one of the two control circuit routes is in a failed state (may be described otherwise as "determined to fail"), there is a high possibility of this failure being accompanied by other failures with respect to the engine controller 28-2 and the throttle controller 28-1 of the control means 28 and, accordingly, normal throttle opening degree control is not carried out and there can be a need to avoid unnecessary control operation in running the vehicle.

Further, in failure diagnosis of a sensor system by the control means 28, there are carried out abnormality diagnosis of the first throttle position sensor 32-1, abnormality diagnosis of the second throttle position sensor 32-2, abnormality diagnosis of the first accelerator position sensor 30-1, abnormality diagnosis of the second accelerator position sensor 30-2, and disconnection diagnosis of the first and the second coils (described also as "starter coil 1", "starter coil 2") 56-1 and 56-2 of the throttle driving motor 26.

According to the engine 2 and in one embodiment of the invention, in order to prevent overrevolution in a high rotational speed region, when a predetermined rotational number (for example, Ne=7500 rpm) is reached, the engine control unit 28-2 operates the fuel injection valve 18 to cut fuel flow into the cylinders.

The throttle valve 24 is electrically operated to a target throttle opening degree so as to control the operational state of the engine 2.

The control means 28 performs engine output restriction based on failure of one of the control circuits, actually, a failure in at least one of the first and second throttle position sensors 32-1 and 32-2 and the first and second accelerator position sensors 30-1 and 30-2 or in abnormality diagnosis of the control circuit by disconnection of the first or second coil 56-1 or 56-2.

Figure 1:
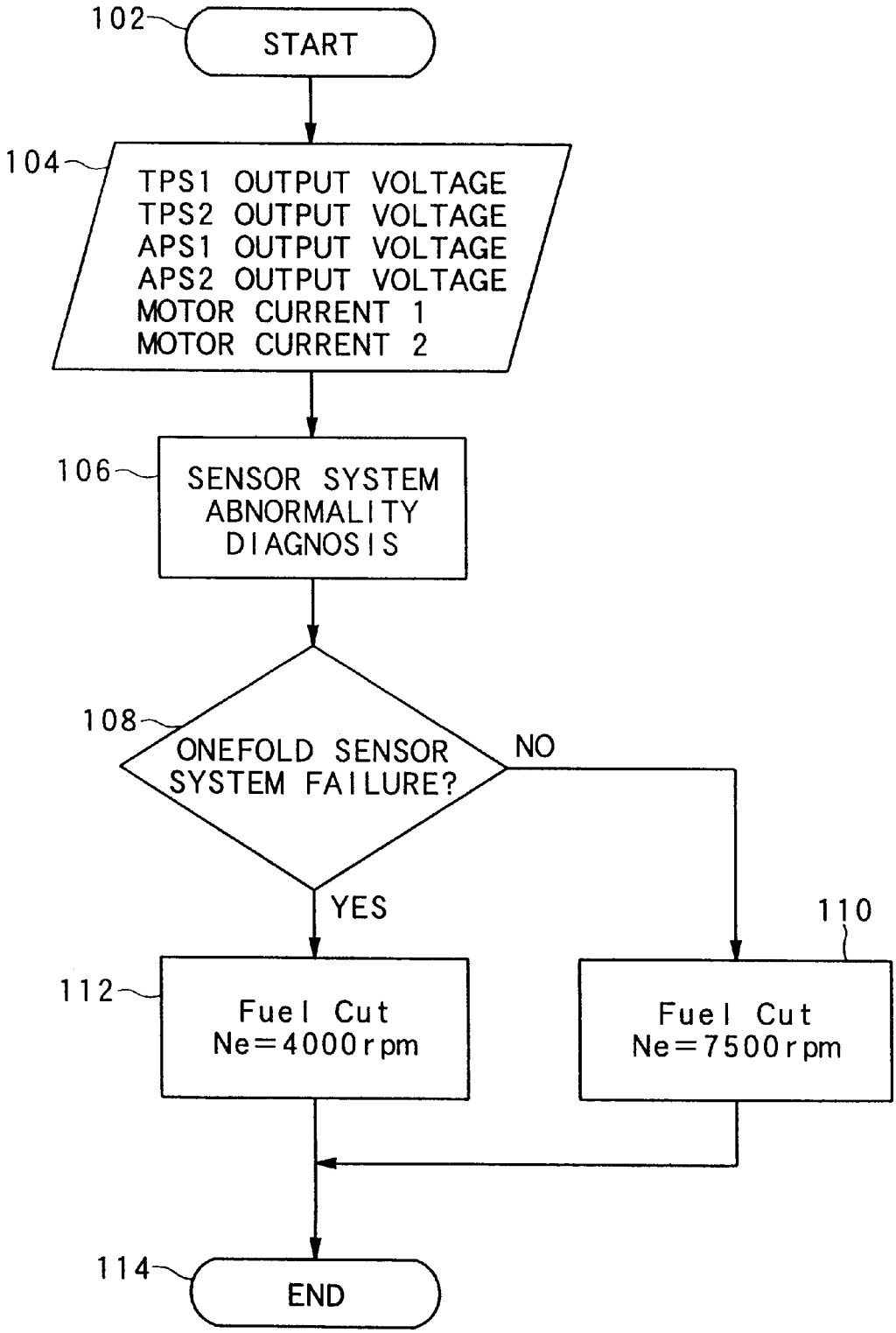
FIG. 1 is a flowchart showing control steps for determining an engine rotational number and fuel cut.

When one sensor in the two routes of respective sensor systems is determined to be in a failure state, as shown in FIG. 1, the control means 28 controls the target throttle opening degree by an output from the other non-failure state sensor, and executes the start of fuel flow cut from a high rotational region to a lower engine rotational number (e.g. Ne=4000 rpm) than the set non-failure state rotational number (e.g. Ne=7500 rpm).

Figure 2:
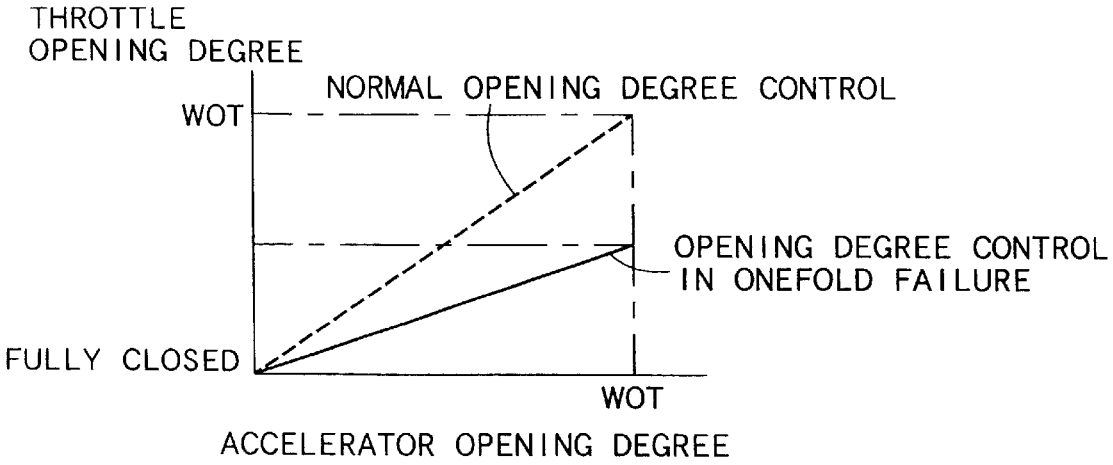
FIG. 2 is a diagram for controlling a target throttle opening degree to substantially one-half thereof.

Further, when one sensor in the two routes of respective sensor systems fails, the control means 28 operates the throttle valve 24 to about one-half of the target throttle opening degree (FIG. 2).

Figure 3:
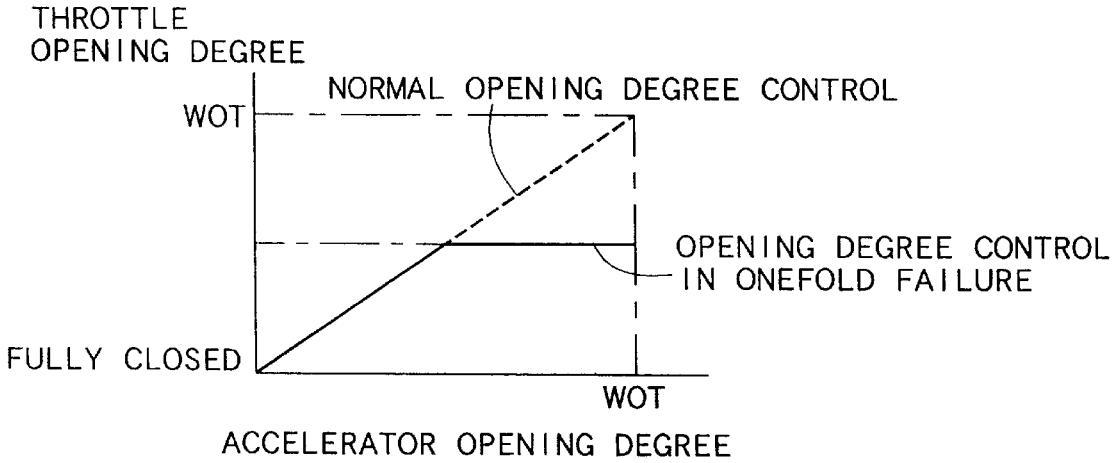
FIG. 3 is a diagram for setting an upper limit value to a throttle opening degree.

Further, when one sensor in the two routes of respective sensor systems is failed, the control means 28 sets an upper limit value to the opening degree of the throttle valve 24 and controls the throttle valve 24 so as to not open it more than the new upper limit value (FIG. 3).

Figure 4:
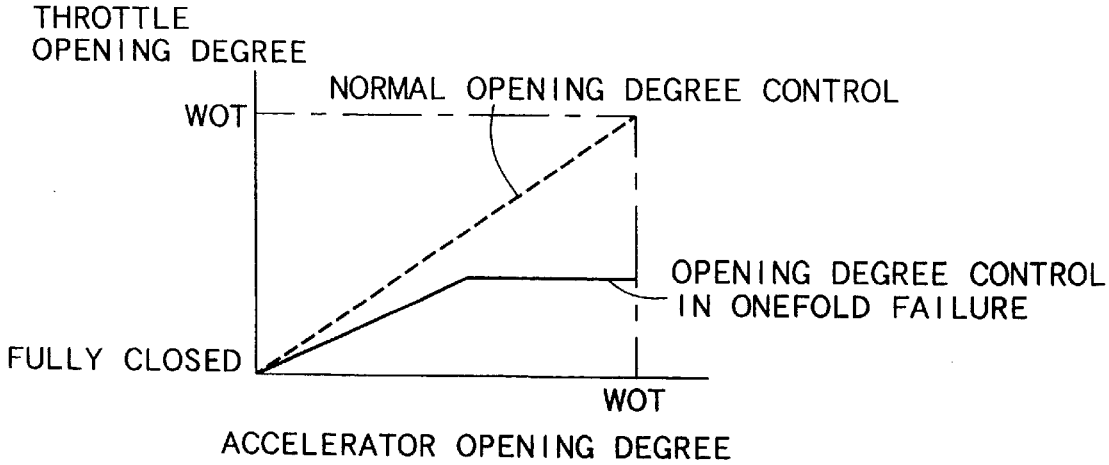
FIG. 4 is a diagram for controlling the target throttle opening degree to substantially one-half thereof and setting an upper limit value to the throttle opening degree.

Further, when one sensor in the two routes of respective sensor systems is failed, the control means 28 controls operation of the throttle valve 24 to about one-half of the target throttle opening degree, sets an upper limit value to the opening degree of the throttle valve 24, and controls the throttle valve 24 so as to not open more than the upper limit value (FIG. 4).

Next, an explanation will be given of the operation of the embodiment in reference to the flowchart of FIG. 1.

When a program started (step 102) in the control means 28, respective output voltages of the first and second throttle position sensors 32-1 and 32-2, respective output voltages of the first and second accelerator position sensors 30-1 and 30-2, and respective currents of the first and second motor drive coils 56-1 and 56-2 (step 104) are input in to the control means 28. Then, failure of one of the twofold sensor system is diagnosed (step 106), successively, i.e. whether or not one sensor system is failed is determined (step 108).

When the determination is NO at step 108, then neither one of the twofold sensor system is failed and accordingly, the fuel cut is executed at a normal stored rotational number (Ne=7500 rpm) (step 110).

On the other hand, when the determination is YES at step 108, the fuel cut is executed at a lower rotational number (Ne=4000 rpm) than the normal set rotational number (step 112).

Then, after the processings at step 110 or 112, the program is ended (step 114).

Further, when one of the sensor systems is in a failed state, as shown in FIG. 2, the throttle valve 24 is controlled to operate at essentially one-half of the target throttle opening degree (FIG. 2), or an upper limit value is set to the opening degree of the throttle valve 24 so that the throttle valve 24 is controlled to not open more than the upper limit value (FIG. 3), or the throttle valve 24 is operated by combining the respective throttle controls of FIGS. 2 and 3 (FIG. 4).

Further, when onefold of the sensor system is in a failed state, the operation of the throttle valve 24 can also be controlled by variously combining the respective throttle controls of FIGS. 1 through 3.

As a result, when failure of one of the two sensor routes is determined, in consideration of the possibility that failure of other sensors is accompanied therewith, in order to avoid abrupt change of running of the vehicle owing to the throttle opening degree, the output of the engine 2 is prevented from increasing more than a certain value, the failure is indicated to the driver, without increasing the depression force required by the brake pedal to brake the vehicle, and further, without fixing the throttle opening degree, the operational state of the engine 2 can be controlled and therefore the vehicle can be run without an out of control feeling being experienced by the driver.

Further, by respectively combining the various throttle controls shown by FIGS. 1 through 3, the operating state of the engine 2 can be finely controlled and the vehicle can be run further and smoother in a failure state.

Further, according to the constitution of the embodiment, an accelerator wire for escape running and peripheral parts are not required, the constitution is simplified and the apparatus can be made more inexpensively.

Further, as a special constitution of the invention, first, when one of the detecting means is determined to be failed, failed portions, failure states and the like are checked. According to the check information, in order to sufficiently achieve the function of normal portions, for example, depending on the failed portion or the failed situation, the vehicle may be run within a range from a stop state to the vicinity of a normal state whereby variations in the countermeasure in the failure of one detecting means are increased, and the vehicle is run in an optimum state and swift escape running can be carried out.

Further, in the failure of one detecting means, when the failure is notified to the driver by voice, image or other measure, the driver can operate the vehicle in a readiness corresponding to the failure of the detecting means and the driver can swiftly deal with the failure of the detecting means.

As is apparent from the above-described detailed explanation, according to the invention, by providing the control means for properly controlling the operating state of the engine when one detecting means is failed in the twofold detecting means in consideration of the possibility of being accompanied by a failure in the other detecting means, the depression force of the brake pedal need not be increased, strange and out of control feeling can be reduced during operation of the vehicle, parts including a throttle wire and so on are dispensed with, the number of parts is reduced, the constitution is simplified, and the apparatus can be made more inexpensively.

Figure 8:
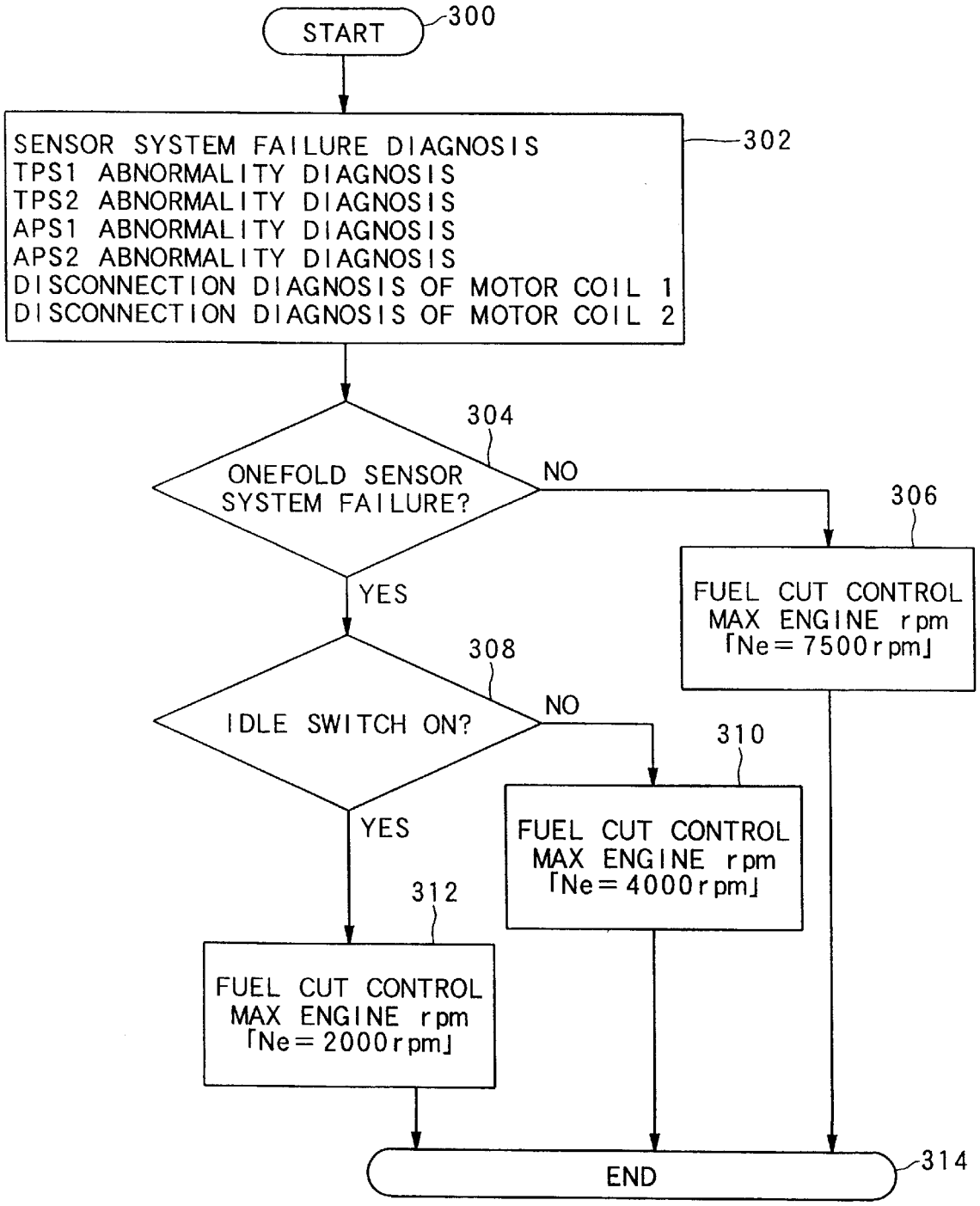
FIG. 8 is a flowchart for controlling escape running of a throttle control apparatus showing a further example of the invention.

In another embodiment of the invention as shown in FIG. 8, when one of the control circuits is in a failed state, the idle switch 34 is in an ON state and the accelerator pedal 20 is brought into its idling operational state, the control means 28 conducts a control to carry out further output restriction.

That is, the control means 26 restricts the maximum vehicle speed by restricting the maximum engine rotational number to 2000 rpm or lower which is smaller than the usual fuel cut engine speed (4000 rpm).

Next, an explanation will be given of the operation in reference to the flowchart of escape running control of FIG. 8.

When a control program is started (300), a failure diagnosis (302) of the sensor system by the control unit 28 is performed.

According to the failure diagnosis (302) of the sensor system by the control means 28, there are performed abnormality diagnosis of the first and second throttle position sensors 32-1 and 32-2, abnormality diagnosis of the first and second accelerator position sensors 30-1 and 30-2 and disconnection diagnosis of the first and second coils 28-1 and 28-2 of the throttle driving motor 26.

After the failure diagnosis (302) of the sensor system by the control means 28, there is performed a determination (304) on whether a onefold failure is caused in the sensor system, that is, whether a failure is caused in one of the redundant control circuits.

When this determination at step 304 is NO, then in order to prevent overrevolution at high revolution of the engine, the maximum engine rotational number Ne is controlled to 7500 rpm by fuel cut control (306) and the control program ends (314).

When the determination (304) of whether a onefold failure is caused in the sensor system, that is, whether a failure is caused in one of the control circuits, is YES, in order to carry out output restriction, the operation shifts to a determination (308) of whether the idle switch 34 is in an ON state. When this determination (308) is NO, the maximum engine rotational number Ne is controlled to 4000 rpm by fuel cut control (310) and the control program ends (314). When the determination (308) is YES, that is, when the idle switch 34 is in the ON state, the maximum engine rotational number Ne is controlled to 2000 rpm by the fuel cut control (312) and the control program ends (314).

Thereby, output restriction can be carried out by the control unit 28 when one of the control circuits is failed and even in the case of being accompanied by other failure in respect of the engine controller 28-2 or the throttle controller 28-1 of the control unit 28, there is no concern of causing unnecessary throttle operation for running the vehicle and running performance can be maintained in an adequate state, which is advantageous.

Further, when the idle switch 34 is in the ON state and there is brought about the idling operating state in which the accelerator pedal 20 is opened, by the control unit 28 performing further output restriction, the idle switch 34 can be used for emergency running, and large variation of the throttle opening degree of the throttle valve 24 can be restrained and smooth running can be ensured.

Further, by installing the control means 28 for carrying out output restriction by restricting the maximum vehicle speed, the maximum vehicle speed is controlled when one of the control circuits is determined to fail by the control unit 28, an increase in vehicle speed is restrained and safety can be improved.

Figure 9:
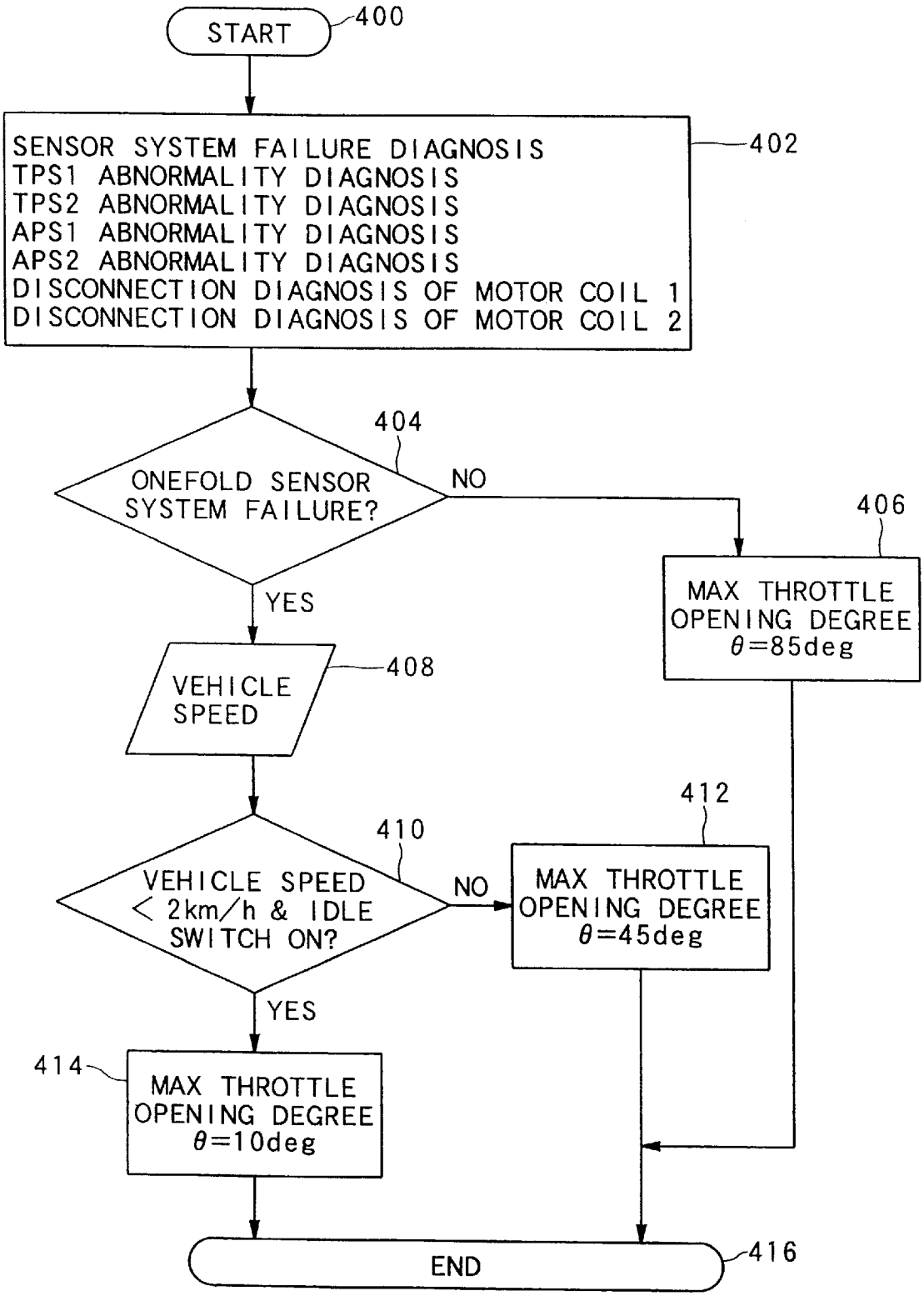
FIG. 9 is a flowchart for controlling escape running of a throttle control apparatus showing yet another example of the invention.

FIG. 9 shows a further embodiment of the present invention. An explanation of this embodiment will be given by using the same reference numerals for the same elements as discussed above.

A characteristic of this embodiment resides in that the control is provided with determining conditions wherein the idle switch is made ON and there is brought about the idling operating state in which the accelerator pedal is opened and in which the vehicle speed is less than a predetermined value and the maximum vehicle speed is restricted by the restriction of the throttle opening degree of the throttle valve. That is, as shown by FIG. 9, when the control program is started (400), failure diagnosis (402) of the sensor system by the control unit 28 is performed.

In the failure diagnosis (402) of the sensor system by the control unit 28, there are carried out abnormality diagnosis of the first and second throttle position sensors 32-1 and 32-2 (TPS1 and TPS2), abnormality diagnosis of the first and second accelerator position sensors 30-1 and 30-2 (APS1 and APS2), disconnection diagnosis of the first and second coils 56-1 and 56-2 of the throttle driving motor 26.

Further, after the failure diagnosis (402) of the sensor system by the control unit, there is carried out a determination (404) of whether a onefold failure exists in the sensor system, that is, whether a failure is found in one of the control circuits.

When the determination (404) is NO, in order to prevent overrevolution of the engine, a maximum throttle opening degree θ is controlled to 85 degrees (406) and the control program ends (416).

On the other hand, when the determination (404) of whether a onefold failure exists in the sensor system, that is, whether a failure is found in one of the control circuits, is YES, in order to carry out output restriction, vehicle speed detection (408) is performed and the operation proceeds to a determination (410) whether the vehicle speed is less than or equal to a predetermined value, for example, 2 km/h or less and the idle switch is in the ON state.

When the determination (410) is NO, the maximum throttle opening degree θ is controlled to 45 degrees (412) and the control program ends (414). When the determination (410) is YES, the maximum throttle opening degree θ controlled to 10 degrees (414) and the control program ends (416).

Thereby, when one of the control circuits is failed, similar to the above-described embodiments, engine output restriction is performed by the control unit and even in the case of being accompanied by other failure in respect to the engine controller or the throttle controller of the control unit 28, there is reduced concern of causing unnecessary throttle operation for running the vehicle and running performance can be maintained in an adequate state, which is advantageous.

Further, when the vehicle speed is a predetermined value, for example, less than 2 km/h and the idle switch is made ON and there is brought about the idling operating state in which the accelerator pedal is opened, by the control unit 28 further restricting output similar to the above-described embodiments, the idle switch can be used for emergency running, and a large variation in the throttle opening degree of the throttle valve can be restrained and smooth running can be ensured.

Further, by installing the control unit 28 for restricting output and the maximum vehicle speed, similar to the above-described embodiments, the maximum vehicle speed is restricted when a failure of one of the control circuits is determined by the control unit and an unnecessary increase in vehicle speed is restrained and safety is improved.

Further, in realizing restriction of the maximum vehicle speed, by restricting the maximum throttle opening degree θ to 45 degree or lower, the control unit 28 accurately restricts output, unnecessary increase in throttle opening degree is restrained and safety is improved.

It is noted that the invention is not limited to the above-described examples but can be applied and modified variously.

For example, although according to one embodiment of the invention the maximum engine rotational number is restricted when one of the control circuits is failed, and according to the second example the vehicle speed detection is carried out and the maximum throttle opening degree is restricted when one of the control circuit is failed. It will be appreciated that the control unit 28 can combine the restriction of the maximum engine rotational number and the restriction of the maximum throttle opening degree into one control operation in which these are switched, or are mixed.

Further, the control unit 28 can be programmed so that when one of the control circuits is failed, a failed portion or a failure situation is further checked, and this checked information is transmitted to the control unit. If the control unit 28 determines the failure is not serious or dangerous, a control mode of the control unit can operate within a range from stopping operation of the engine up to a vicinity of normal engine operation. For example, additional sensors, wiring, and diagnostic steps in the controller are installed to provide the further check information.

Additionally, the driver can be informed of the failure of one of the control circuits by audio, images or other measures. Thereby, the failure information is notified to the driver, the driver can drive with the failure and safe emergency running of the vehicle can be performed.

The engine rpm numbers, high first fuel cut, and idle engine speed (Ne) are examples of preferred embodiments of the present invention. While these numbers are preferred, it is understood that these numbers can be varied according to the operating conditions. The operating conditions include, but are not limited to, engine size, vehicle size, etc. Varying the engine rpm limits for a high rpm limit, fuel cut limit and idle limit lie within the scope and spirit of this invention. Moreover, the throttle opening degree limits can also be varied and remain within the scope of this invention.

Although a particular preferred embodiment of the invention has been disclosed in detail for illustrative purposes, it will be recognized that variations or modifications of the disclosed apparatus, including the rearrangement of parts, lie within the scope of the present invention.

What is claimed is:

1. A throttle control apparatus comprising:

an engine which executes a fuel cut at a first predetermined engine rotational number to prevent overrevolution in a high rotational number region;

a throttle system including a throttle valve which is electrically operated to control an operating state of the engine;

a twofold detecting means for detecting failure in the throttle system;

an idle switch for detecting that an accelerator pedal for controlling the engine is in an engine idling operational state; and control means for executing the fuel cut of the engine to a second engine rotational number lower than the first predetermined engine rotational number when one of the twofold detecting means is determined to be in a failed state, and for executing the fuel cut of the engine to a third engine rotational number lower than the second engine rotational number when one of the twofold detecting means is determined to be in a failed state and the accelerator pedal is in the engine idling operational state.

2. A throttle control apparatus according to claim 1, wherein said control means controls operation of the throttle valve to about one-half of a target throttle opening degree when one of the twofold detecting means is in a failed state and the accelerator pedal is not in the engine idling operational state.

3. A throttle control apparatus according to claim 2, wherein when one of the twofold detecting means is in a failed state, the control means sets an upper limit value of the opening degree of the throttle valve and controls the throttle valve to not open more than the upper limit value.

4. A throttle control apparatus according to claim 1, wherein when one of the twofold detecting means is in a failed state, said control means sets an upper limit value of the opening degree of the throttle valve and controls the throttle valve to not open more than the upper limit value.

5. A throttle control apparatus for an engine, comprising:

a throttle system including throttle valve electrically operated to a target throttle opening degree to control an operating state of the engine;

a twofold detecting means for detecting failure in the throttle system;

an idle switch for detecting that an accelerator pedal for controlling the engine is in an engine idling operational state; and control means for restricting operation of the throttle valve to about one-half of a maximum throttle opening degree when one of the twofold detecting means is in a failed state and for restricting the throttle valve to open less than about one-half of the maximum throttle valve opening degree when the accelerator pedal is in the engine idling operational state and one of the twofold detecting means is in a failed state.

6. The throttle control apparatus according to claim 5, wherein the control means sets an upper limit value to the maximum throttle opening degree of the throttle valve when no failed state is determined and controls the throttle valve to not open more than the upper limit value.

7. A throttle control apparatus for an engine, comprising:

accelerator position sensors for detecting a depressed amount of an accelerator pedal which controls the engine, throttle position sensors for detecting a throttle opening degree of a throttle valve, coils of a throttle driving motor for driving a throttle valve, a control device for controlling the throttle opening degree of the throttle valve by communicating with the accelerator position sensors, the throttle position sensors and at least one of the coils, two routes of control circuits each arranged with a respective one of the accelerator position sensors, the throttle position sensors and the coils, and an idle switch coacting with both routes of the control circuits for detecting that the engine is in an engine idling operational state, and the control device controlling an output restriction when one of the control circuits fails and further restricts the output restriction when the idle switch is in an ON state indicating that the accelerator pedal is in the idling operating state.

8. The throttle control apparatus according to claim 7, wherein the control device determines that the idle switch is in an ON state and vehicle speed is less than a predetermined value to further restrict the output restriction.

9. The throttle control apparatus according to claim 8, wherein the control device performs the output restriction by restricting a maximum vehicle speed.

10. The throttle control apparatus according to claim 9, wherein the control device restricts the maximum vehicle speed by restricting a maximum throttle opening degree.

11. The throttle control apparatus according to claim 7, wherein the control device performs the output restriction by restricting a maximum vehicle speed.

12. The throttle control apparatus according to claim 11, wherein the control device further restricts the maximum vehicle speed by restricting a first maximum engine rotational number to a second lower engine rotational number by carrying out fuel cut control.

13. The throttle control apparatus according to claim 11, wherein the control device restricts the maximum vehicle speed by powering one of the coils of the throttle driving motor to restrict the throttle opening degree to a restricted maximum throttle opening degree that is less than a maximum throttle opening degree.

14. The throttle control apparatus according to claim 12, wherein the first maximum engine rotational number is about 7500 rpm and the second lower engine rotational number is about 4000 rpm.

15. The throttle control apparatus according to claim 12, wherein the maximum engine rotational number is about 7500 rpm, the second engine rotational number is about 4000 rpm, and an idle maximum engine rotational number is about 2000 rpm.

16. The throttle control apparatus according to claim 13, wherein the maximum throttle opening degree is about 85°, the restricted maximum throttle opening degree is about 45°, and an idle maximum throttle opening degree is about 10°.

* * * * *